US007353575B2

(12) United States Patent
Buchmüller

(10) Patent No.: US 7,353,575 B2
(45) Date of Patent: Apr. 8, 2008

(54) METHOD AND DEVICE FOR PRODUCING A FANCY KNOTTED YARN

(75) Inventor: Patrick Buchmüller, Krummenau (CH)

(73) Assignee: Oerlikon Heberlein Temco Wattwil, Wattwil (CH)

( * ) Notice: Subject to any disclaimer, the term of this patent is extended or adjusted under 35 U.S.C. 154(b) by 604 days.

(21) Appl. No.: 10/490,862

(22) PCT Filed: Sep. 27, 2002

(86) PCT No.: PCT/CH02/00540

§ 371 (c)(1),
(2), (4) Date: Sep. 13, 2004

(87) PCT Pub. No.: WO03/029539

PCT Pub. Date: Apr. 10, 2003

(65) Prior Publication Data

US 2005/0011061 A1 Jan. 20, 2005

(30) Foreign Application Priority Data

Sep. 29, 2001 (CH) ..... 1794/01

(51) Int. Cl.
*D02G 1/16* (2006.01)

(52) U.S. Cl. ..... 28/271; 28/274; 28/276

(58) Field of Classification Search ..... 28/271, 28/274, 276, 275, 273, 272, 254, 255, 283, 28/252; 57/333, 350, 908
See application file for complete search history.

(56) References Cited

U.S. PATENT DOCUMENTS

| | | | | | |
|---|---|---|---|---|---|
| 3,474,510 | A | * | 10/1969 | Torsellini | 28/275 |
| 3,571,868 | A | * | 3/1971 | Buzano | 28/275 |
| RE28,254 | E | * | 11/1974 | Buzano | 57/333 |
| 4,188,692 | A | * | 2/1980 | Pike | 28/271 |
| 4,245,378 | A | * | 1/1981 | Price | 28/271 |
| 4,575,999 | A | * | 3/1986 | Anahara et al. | 57/333 |
| 6,112,386 | A | * | 9/2000 | Weinsdorfer et al. | 28/274 |
| 6,134,759 | A | * | 10/2000 | Saijo et al. | 28/274 |
| 6,311,376 | B1 | * | 11/2001 | Hinchliffe et al. | 28/272 |
| 6,438,812 | B1 | * | 8/2002 | Jansen | 28/274 |
| 6,609,278 | B1 | * | 8/2003 | Ritter et al. | 28/271 |
| 6,834,417 | B1 | * | 12/2004 | Buchmuller | 28/271 |

* cited by examiner

*Primary Examiner*—A. Vanatta
(74) *Attorney, Agent, or Firm*—Finnegan, Henderson, Farabow, Garrett & Dunner, L.L.P.

(57) ABSTRACT

The invention relates to a method and a device for producing a fancy knotted yarn. The treatment air is injected into the yarn channel as primary air via a main bore hole, and as secondary air preferably via two auxiliary bore holes. The introduction of primary air is designed to create a double air vortex, and the introduction of secondary air is designed to ensure the yarn transport and to stabilise the air flow in the yarn channel. The novel solution has surprising advantages in terms of a plurality of quality criteria, predominantly shorter opening lengths, a more uniform vorticity, a number of knots which is higher by approximately 10%, and the possibility of using coarser titers.

17 Claims, 7 Drawing Sheets

FIG 1
PRIOR ART
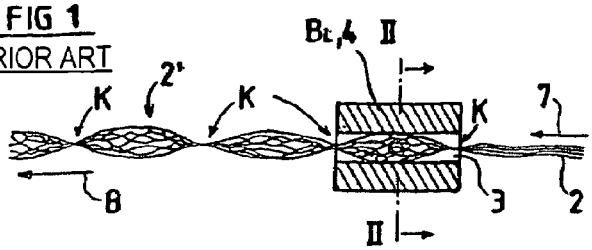
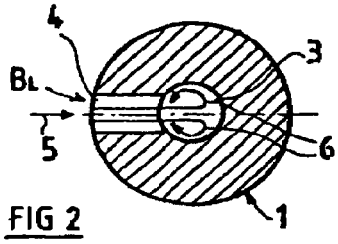
FIG 2
PRIOR ART
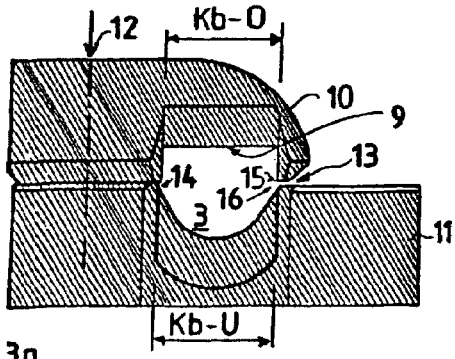
FIG 3a
PRIOR ART
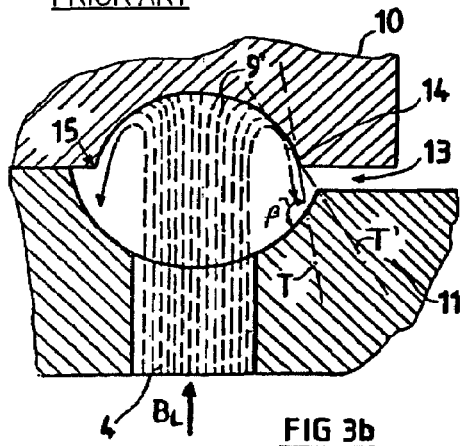
FIG 3b
PRIOR ART
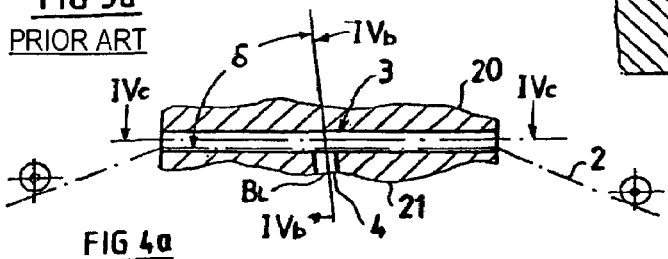
FIG 4a
PRIOR ART
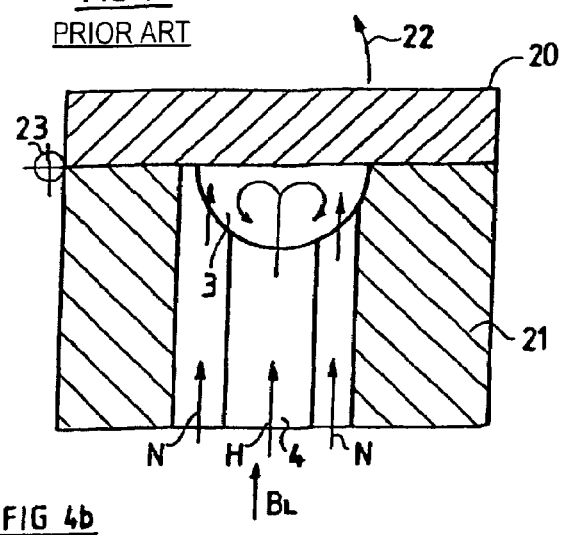
FIG 4b
PRIOR ART
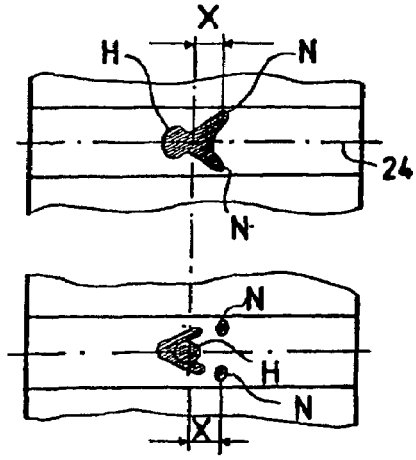
FIG 4c
PRIOR ART

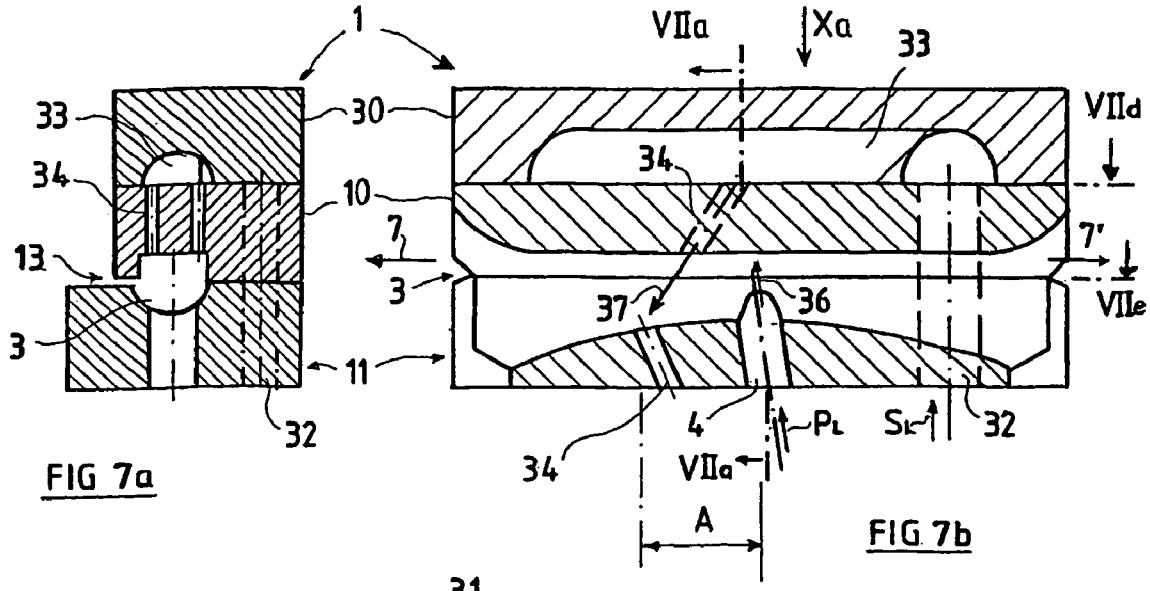
FIG 7a
FIG 7b
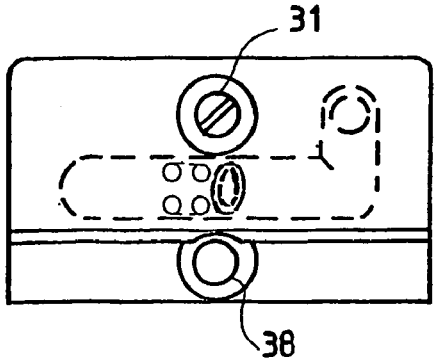
FIG 7c
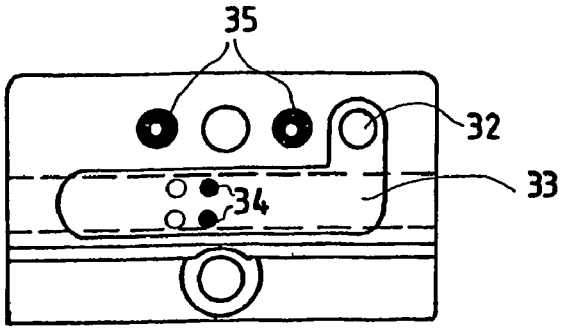
FIG 7d
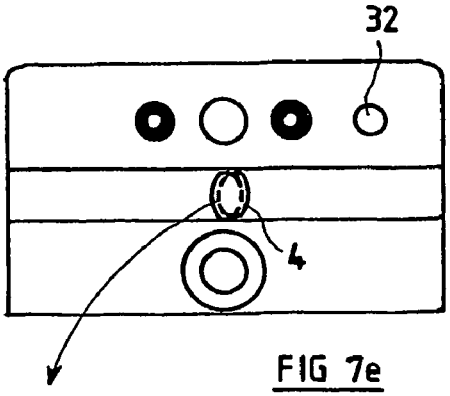
FIG 7e
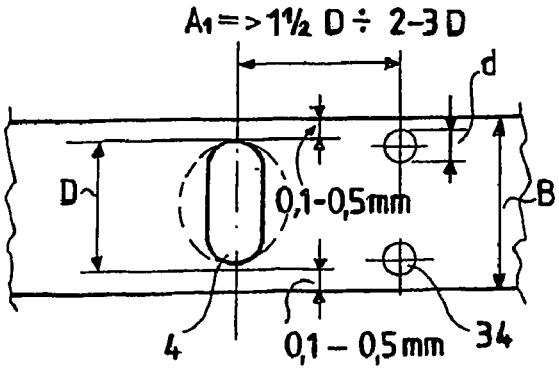
FIG 7f

METHOD AND DEVICE FOR PRODUCING A FANCY KNOTTED YARN

TECHNICAL FIELD

This invention relates to a method and a device for producing knotted yarn from spin-textured filament yarn in a continuous yarn channel of an interlacing nozzle with a main bore directed centrally at the yarn channel axis for the primary air and at least one auxiliary bore at a distance from the main bore for secondary air.

STATE OF THE ART

Knotted yarn is produced for various fields of use by an air interlacing process: very large titers such as those used for BCF yarns, fine yarns for textile titers or for smooth yarns. The individual filaments of a smooth or textured filament yarn are tied together by means of interlaced spots. The goal of this treatment is to achieve better processability, e.g., in bobbin draw-off, weaving or knitting without expensive twisting operations or smoothing processes. The compactness of the thread of the tangled yarns is created by means of interlacing nozzles. One particular advantage of these nozzles is that they are functional even at the full production speed of spinning, drawing and stretch-texturing processes. They may therefore be used in-line in these processes as the least expensive elements. The core part of an interlacing nozzle is the yarn channel with a transverse bore for the supply of compressed air.

On the basis of model concepts so far, the filament structure of the running thread is opened in the manner of a bubble by the air stream through the transverse bore. Due to the substream eddies, the filaments at the right and left of the transverse bore within the yarn channel are set in rotation in opposite directions. This results in interlaced filaments, referred to as interlaced spots and/or knots, upstream and downstream from the air bore. When the interlaced spot leaves the air stream, the relative movement of the individual filaments is stopped due to the interlacing. Then unbraided filaments are continuously entering the nozzle due to further conveyance of the thread. Then the process begins from the beginning. Therefore, the formation of knots is a discontinuous process.

The object of interlacing is to achieve compactness of the thread, i.e., better cohesion of the individual filaments. The interlacing quality is evaluated on the basis of the three criteria: interlacing density, interlacing uniformity and interlacing stability. The most commonly used method of evaluating the quality of interlacing is to measure the average number of interlaced spots per meter. However, this method says little about the individual distances between the interlaced spots. The standard deviation of the interlacing density on the basis of several measurements also does not provide any relevant information regarding the interlacing uniformity. However, if the open lengths are measured, one need only determine the minimum value (Ölmin.) and the maximum value (Ölmax.). The test results Ölmin. of 0.6 cm to 1.3 cm means that all the distances between the interlaced spots are within 0.6 cm to 1.3 cm. This is a very precise statement of quality and it is not even necessary to state the number of interlaced spots per meter.

The third important quality criterion is the interlacing stability. Interlacing must withstand the thread tension forces that occur during processing with regard to the compactness of the thread, i.e., the interlaced spots must not become uninterlaced during processing. However, so-called hard interlaced spots are more visible in the textile structure than soft interlaced spots. Therefore, the interlacing stability is preferably adapted to the given use, i.e., the material is selected to be only as hard as is necessary. A good statement regarding the use-specific interlacing stability is obtained with a load series in which the interlacing density at a corresponding yarn load is measured and compared with the basic load results.

Over the course of development work it has been found that with the help of the interlacing technique it is possible to combine a much larger spectrum of different yarns. First, existing twisted "multicomponent classics" can be substituted while on the other hand completely novel yarn combinations tailored to meet certain needs can be produced. Almost all types of filament yarn can be interlaced together with other filament yarns, polyarnide, polyester, polypropylene, viscose, acetate, etc. if at least one component meets certain prerequisites with regard to the fineness ratio and bending strength.

Three basic types of air interlacing nozzles are distinguished: the closed nozzle, the open nozzle with a threading slot and a mixed type of the two, the open/closed nozzle. In the case of the closed nozzle, the yarn must be drawn into the nozzle by means of intake air with appropriate threading aids for threading it through. The open nozzle has a threading slot that is open continuously so that even the running yarn can be threaded in by hand. The open/closed nozzle has mechanical movable means. The nozzle is usually designed in two parts, with one part having the compressed air supply being fixedly mounted on the machine. The second part is the movable part and is either brought into the open position for the threading or into the closed position for the normal production operation. The open nozzles like the open/closed nozzles are usually designed in two parts and preferably have a planar baffle surface in addition to the threading slot in the part opposite the air supply. The baffle surface plays an important role in the interlacing function. The closed nozzle has become less important in comparison with the two other basic types.

The process speed, especially in the production spin-stretch-textured carpet yarns, has increased in recent years from approximately 2000 m/min to 3500 m/min. For spin-stretch machines, a speed range of 4000 to 6000 m/min or more is the goal. Since interlacing occurs in-line after texturing but before spooling, the goal of working optimally without a loss of quality with a yarn transport rate of 3000 to 6000 m/min, for example, also applies to the interlacing nozzles. The interlacing nozzles used for textured yarns usually have a blasting air channel which is at a slight inclination in relation to the conveyance direction of the yarn. The inclination from the vertical is usually 10° to 15° and yields a slight conveyance effect for the yarn passing through it, but that is lower than the sum of the resistance forces counteracting the yarn in the nozzle. At higher inclination values of the blasting nozzle, i.e., when there is a greater conveyance effect, however, the interlacing efficacy declines accordingly and the loopiness of the yarn increases. Another consequence of the interlacing at high speeds is the need to increase the air pressure. This results in a higher density of the air in the yarn channel. At high process speeds, one would like to achieve an interlacing density and interlacing quality that are as similar as possible to those obtained at low process speeds in order to ensure further processing of the yarn uniformly. Experiments have shown that the thread tension at the nozzle outlet achieves an ever greater percentage increase value in comparison with the input thread tension with an increase in the yarn speed and with a higher air pressure of the blasting nozzle at the same time. At 4000 m/min, an output thread tension with a value of 120 to 160 is obtained when the initial thread tension has a value of 100. However, a 20 to 60% increase is very harmful for the yarn.

European Patent 0 326 552 describes an open/closed nozzle having a slightly inclined angle for the injection of air. An important aspect is the expansion of cross section from the air injection site in both directions to the inlet and outlet of the yarn channel. European Patent 0 465 407 proposes an approximately constant cross section while German Patent 197 00 817 proposes an expanding cross section.

An interesting nozzle design is proposed with German Patent 41 13 927 which relates to a closed nozzle having a planar baffle surface on the side opposite the air injection. Secondary air is also injected tangentially into the yarn channel in addition to the air injection as primary air. German Patent 41 13 927 classifies an air stream as "direct," i.e., striking the thread at a right angle, "indirect," i.e., striking the thread obliquely at a certain angle or "pulsating," i.e., the air is supplied in surges. The air stream is always at the center of the yarn channel. The interlacing fluid, mainly air, is often directed at a very specific angle onto the thread, thus achieving a certain conveyance effect. Especially in processing BCF yarns which are used in carpeting and have a dtex of up to 6000, clean interlacing is often impossible because the air supply is not sufficient. Very high operating pressures and large quantities of air accordingly are hardly able to remedy this situation. German Patent 41 13 927 is based on the object of developing an interlacing nozzle that will achieve a high degree of cleaner interlacing and will also reduce air consumption. An interlacing nozzle has been proposed, mainly for processing BCF yarn, with an interlacing air channel running toward the yarn at a certain angle, with two other support channels having a reduced diameter in comparison with the main channel and being arranged in such a way that the air jets passing by the yarn on the right and left envelop the yarn. Depending on the thread travel in relation to the direction of travel of the yarn, the support channels are situated above or below the main channel. It is interesting that all experiments by the present applicant with the embodiment in accordance with German Patent 41 13 927 have not yielded any advantages with regard to an improvement in knot formation.

EXPLANATION OF THE INVENTION

The object of this invention is to provide a novel method and a novel device with which a high knot quality can be achieved specifically by having an influence on possible basic parameters of interlacing even at higher yarn conveyance speeds.

The inventive method is characterized in that the primary air is supplied into the yarn channel at a right angle or at only a low rate of conveyance and the secondary air is supplied through the at least one auxiliary bore in support of the eddy current and with a conveyance effect.

The inventive device is characterized in that the main bore is arranged perpendicular to the yarn channel axis or at a slight angular deviation for or against a slight conveyance effect onto the yarn and the auxiliary bore(s) is/are inclined to the axis of the yarn channel and is/are arranged to be directed in various ways that are different from the primary air.

The fact that all attempts with auxiliary bores directed at a right angle at the yarn channel have not yielded any improvements at all is of interest. However, a slight inclination, especially in the direction of conveyance but to some extent also opposite the direction of conveyance has yielded surprising improvements. Furthermore, it has been found that the same alignment of the main bores and the auxiliary bores, e.g., in accordance with WO99/19549 has also failed to yield any improvement.

In larger experimental series, the results obtained according to German Patent 41 13 927 as well as the novel invention have been compared. The result was surprising inasmuch as almost no improvement was discernible with embodiments according to the teaching of German Patent 41 13 927 in comparison with the relevant related art. However, experimental results with this novel invention have yielded a number of improvements:

- a reduction in pressure and a reduction in air consumption
- a shorter opening length
- more uniform interlacing
- number of knots approx. 10% higher
- higher titers may be used in the nozzle, e.g., 2600 dtex instead of 1800 dtex, which is thus an increase amounting to about 40%.

This novel invention allows in particular three positive effects, namely:

- centering and stabilization of the yarn in the yarn channel
- targeted conveyance function for the yarn regardless of the interlacing function
- a rotation aid for optimization of knot formation.

The best results were obtained with interlacing nozzles having bent yarn channels.

This novel invention allows a number of particularly advantageous embodiments. Reference is made in this regard to claims 2 through 7 and 9 through 13.

BRIEF DESCRIPTION OF THE INVENTION

The novel design is explained in greater detail below on the basis of the state of the art with a few exemplary embodiments, which show:

FIG. 1 a purely schematic diagram of the interlacing technique using a closed nozzle;

FIG. 2 a section II-II in FIG. 1;

FIG. 3*a* a view of an interlacing nozzle in the axial direction in the interlacing channel;

FIG. 3*b* the flow pattern in the area of air injection;

FIG. 4*a* a longitudinal section through the interlacing channel of a design according to the state of the art;

FIG. 4*b* a section IVb-IVb from FIG. 4*a;*

FIG. 4*c* a section IVc-IVc from FIG. 4*a;*

FIGS. 5*a* and 5*b* together show the results of a model calculation of the flow in an interlacing nozzle known in the state of the art;

FIGS. 6*a* and 6*b* show the results of a model calculation of the flow in an inventive interlacing nozzle according to FIGS. 7*a* and 7*b;*

FIG. 7*a* a section along line VIIa-VIIa in FIG. 7*b;*

FIG. 7*b* a section along line VIIb-VIIb in FIG. 7*a;*

FIG. 7*c* a view of FIG. 7*b* according to arrow Xa;

FIG. 7*d* a view of FIG. 7*b* according to arrow Xb;

FIG. 7*e* a view of FIG. 7*b* according to arrow Xc;

FIG. 7*f* a view of the air bore from FIG. 7*b;*

FIG. 8 a perspective diagram of an inventive three-piece interlacing nozzle for the production of BCF yarn;

FIG. 8*a* a slide jet designed with the yarn channel open/closed;

FIGS. 9 and 10 two other embodiments of an inventive interlacing nozzle;

FIG. 11 a sample of interlaced yarn according to the state of art;

FIG. 12 a sample of interlaced yarn according to the novel invention.

MEANS AND EXECUTION OF THE INVENTION

Reference is now made to FIGS. 1 and 2 in the following discussion. The interlacing nozzle 1 and the interlacing effect on the yarn 2 are indicated purely schematically here. FIG. 2 shows a section II-II from FIG. 1. The nozzle depicted here is a closed nozzle having a continuous cylindrical bore for the yarn channel 3. In the central area, a compressed air supply bore 4 is provided perpendicular to the yarn channel 3 in the nozzle body of the interlacing nozzle 1. The compressed air (blasting air BL) is injected at a pressure of 1 to 10 bar or more, for example, through the pressurized air supply bore 4 into the yarn channel 3, as indicated by the arrow 5. An interlaced yarn 2' having knots K and/or with the typical knot structure which is also discernible with the naked eye on the yarn, is formed from the yarn which is passed through the yarn channel 3 as a smooth or textured yarn 2. The compressed air 5 is divided in a yarn channel 3 into two partial current eddies 6 which are then actual causative factors in the opening and interlacing. The yarn 2 is fed into the yarn channel 3 at a constant rate of conveyance, which is indicated with an arrow 7. The knotted yarn 2' is drawn off at a regulated rate according to arrow 8.

FIG. 3 shows a view of an interlacing nozzle enlarged by a factor of approximately four for the production of BCF yarn. At relatively low yarn conveyance rates of less than 1000 m/min, the baffle surface 9 may still be rounded (FIG. 3*b*). At a high and extremely high output of up to 3000 m/min, especially from 3000 to 6000 m/min, however, the baffle surface is preferably designed as a planar surface, as depicted in FIG. 3*a*. The nozzle body in FIGS. 3*a* and 3*b* is divided into two parts with compressed air supplied from beneath as indicated by the arrow BL. The baffle surface 9 is mounted in an upper nozzle body 10 with an upper yarn channel half. The nozzle body 10 is fixedly connected to a lower nozzle body 11 by a screw connection 12. The advantage of the two-part design is that each nozzle body part is first that the yarn channel can be produced in any shape because each nozzle body part is machined completely independently. As a second major advantage, a threading slot 13 may be provided between the upper and lower nozzle body parts. This allows threading while the yarn 7 is running without having to move anything mechanically on the nozzle. A particularly advantageous design idea of the open nozzle form by the present applicant is obtained when the channel width Kb-O in the upper nozzle body part 10 is somewhat smaller than the corresponding channel width Kb-U in the lower nozzle body part 11. Reference is made in this regard to U.S. Pat. No. 5,010,631. Due to the corners 14 and/or 15 which therefore protrude on the side of the baffle surface, especially the resulting flow deflection, the plane of separation between the upper nozzle body part 10 and the lower nozzle body part 11 does not have any negative effect. This is true of the area of the threading slot 13 in particular. The straight line T may strike at most the edge 16 of the dividing plane of the lower nozzle body part 11, as indicated with T' in FIG. 3*b*. This prevents too much air from escaping out of the threading slot, but in particular it prevents the yarn from being damaged on the respective edges and not being able to come out through the threading slot during operation.

FIGS. 4*a*, 4*b* and 4*c* show a proposal for another embodiment of a known two-part interlacing nozzle. Reference is made in this regard to WO99/19549. The open position must be adjusted by moving the upper nozzle body 20, as indicated with arrow 22 and joint 23. In other designs known in the state of the art, the upper nozzle body 20 is rotated or shifted with respect to the lower nozzle body 21 to open the yarn channel 3. FIGS. 4*b* and 4*c* show in particular the compressed air supply divided as main air H and secondary air N. The secondary air is injected symmetrically and essentially in the same direction into the yarn channel. The direction of the blasting air in the yarn channel has a very strong conveyance effect, as indicated with the angle δ and is preferably between an angle δ of 60° to 87°. The main air H and the secondary air N are blown in the direction of the yarn channel longitudinal axis 24 at a slight distance X, whereby the main air and the secondary air can be arranged with an offset in or against the direction of flow.

FIGS. 5*a* and 5*b* show the results of a model calculation of an interlacing nozzle according to the FIGS. 3*a* and 3*b*. It is important for an understanding of the novel invention that the model calculations were performed only with pure air and without using yarn. A precise flow calculation with yarn passing through is not even possible with the computer programs known at the present time. It has been found that it is not the air interlacing, as previously assumed, but rather the disturbance within the interlacing zone due to the filaments and/or due to the single filaments that produces the interlacing effect. The individual filaments are then subjected to the interlacing individually with large forces and enormous velocities. These novel findings have some fundamental consequences for the design and embodiment.

- The primary goal must not be to optimize the turbulent flow per se, e.g., from the standpoint of an oscillating effect of the yarn passing through.
- The goal must instead be to stabilize and optimize the turbulent flow, in particular with preference for the direction of yarn transport and at least partially independently thereof to optimize the yarn transport function.
- The secondary air has the function of a thread guide integrated into the yarn channel.

This novel invention proposes a supply of primary air and secondary air, as explained below on the basis of FIGS. 6*a* and 6*b*. Since the compressed air supply in the example according to FIGS. 5*a* and 5*b* is inclined slightly in the direction of conveyance, the result is a greater eddy current in the direction of the yarn channel outlet Ak2. This is discernible by the greater concentration of lines in the outlet area. The diagram according to FIGS. 6*a* and 6*b* is based on an identical nozzle design shape according to FIGS. 5*a* and 5*b*. In FIGS. 6*a* and 6*b*, two auxiliary bores for secondary air SL are shown inclined at an angle δ relatively greatly in the direction of transport. The two auxiliary bores are arranged symmetrically in the particular edge areas of the yarn channel as marked with the distance measure Z. As a variant, δ' indicates this possibility.

When the results in FIGS. 5*a*, 5*b* and 6*a*, 6*b* are compared, three noteworthy zones A, B and C can be seen in FIGS. 6*a* and 6*b*. The result is a slightly intensified zone A in region Ak1 and a corresponding zone C in region Ak2. It is completely surprising that a very stable boundary flow zone B1 and/or B2 is established in the main interlacing zone V-V on both sides of the yarn channel. This is the zone where the knots are actually subject to a great influence in contrast with the section Ö which serves primarily to open the yarn. Since the lateral edge area is stabilized with the secondary air and a strong conveyance effect is generated, the formation of knots can be influenced surprisingly in a positive manner in all essential quality criteria, as explained above.

FIGS. 7*a* through 7*e* show the nozzle shape with which large series of experiments were conducted, and which was also selected as the basis for the model calculations according to FIGS. 6*a* and 6*b*. FIGS. 7*a* through 7*e* represent a two-part open nozzle with a cover. The top part 30 is tightened onto the nozzle body 10 to form an airtight seal, and the nozzle body 10 is tightened precisely onto the nozzle body 11 via a tension screw 31 (FIG. 7*c*). The top part 30 serves to supply the secondary air SL, which is supplied through a bore 32 passing through the nozzle body part 10 and the nozzle body part 11 and through a channel 33 into the top part 30. The secondary air SL is fed in through two auxiliary bores 34 which pass through the nozzle body part 10, inclined in the direction of yarn transport and open into the yarn channel. For the precise positioning of the nozzle body 10 with respect to the nozzle body 11, a fitting pin connection 35 is additionally provided. This ensures that the yarn channel itself as well as the primary and secondary air supply are reproducibly adapted mutually at any point in time. The primary air PL is supplied through the compressed air supply bore 4. The yarn channel as shown in FIG. 7*b* is designed so that it widens symmetrically in both directions on both sides of the compressed air supply bore 4. The widened area is advantageously designed only in the lower nozzle body 11. The primary air is blown in with a slight conveying effect in FIGS. 7*a* through 7*e*. Another aspect of special advantageous design is that the primary air and the secondary air are introduced into the yarn channel in exactly opposite locations, as indicated by the arrows 36 and 37. The entire interlacing nozzle 1 is shown in a top view according to arrow IXe in FIG. 7*c* and in the respective planes IXd and IXe in FIGS. 7*d* and 7*e*. The interlacing nozzle 1 is mounted on the machine end via the bore holes 31 and 38. FIG. 7*f* shows a preferred embodiment with a main bore having an elongated hole and/or an oval shape, the outer edge of bore being at a distance of at least 0.1 to 0.5 mm from the yarn channel wall and/or not extending all the way to the edge of the yarn channel with the width B. The distance A1 is the effective distance in the yarn channel. In contrast with WO99/19549, the auxiliary bores do not simply have a reinforcing function to the main air but instead should directly support the formation of the eddy.

FIG. 8 shows a two-part nozzle 1 having been assembled with a cover for the secondary air supply shown in a perspective view with the top part 30 and the nozzle bodies 10 and 11.

FIG. 8*a* shows an embodiment with a yarn channel that can be opened for threading and closed for operation. Reference is made to WO97/11214 with regard to the design embodiment.

FIG. 9 shows an embodiment having an additional pressure relief bore. The pressure relief bore has multiple functions. In particular, this makes it possible to promote development of air interlacing in the direction of conveyance downstream from the point of introduction 4 for the primary air. With the pressure relief bore which is centrally located like the compressed air supply bore 4, the effect of the secondary air is enhanced and the development of the eddy is additionally stabilized.

Figure 5A:
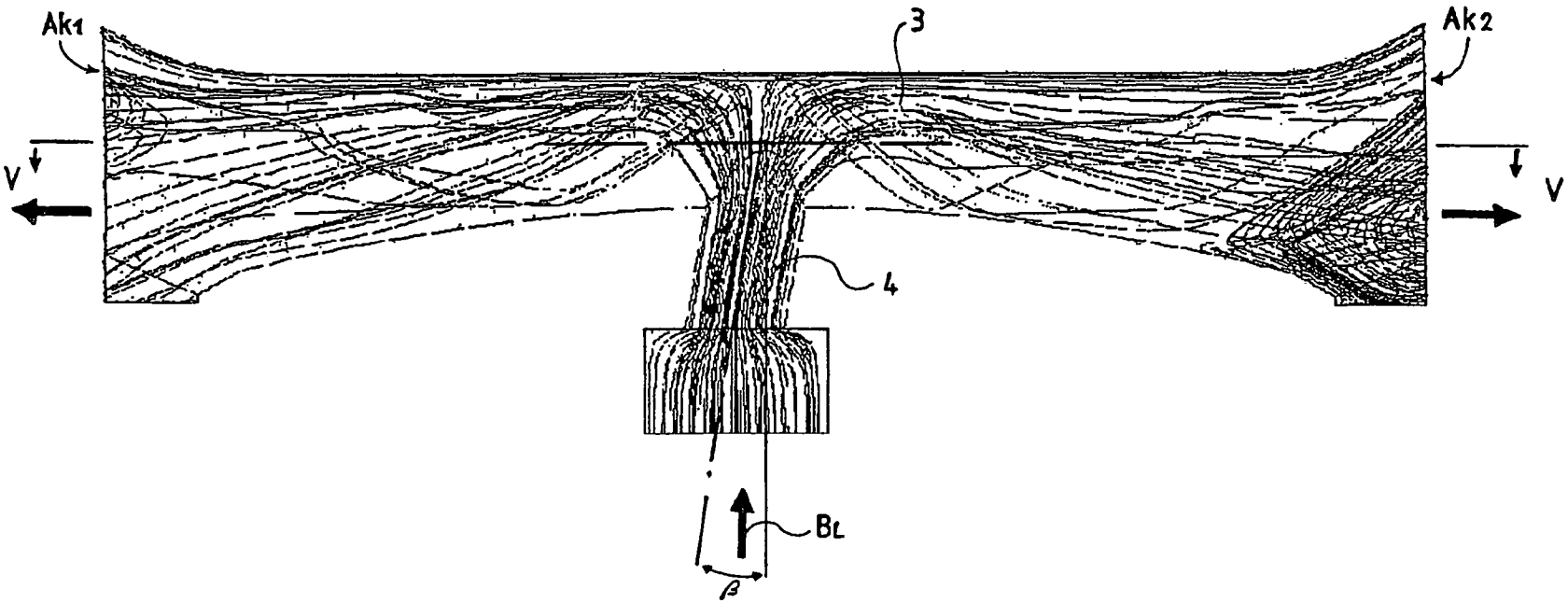
Figure 5B:
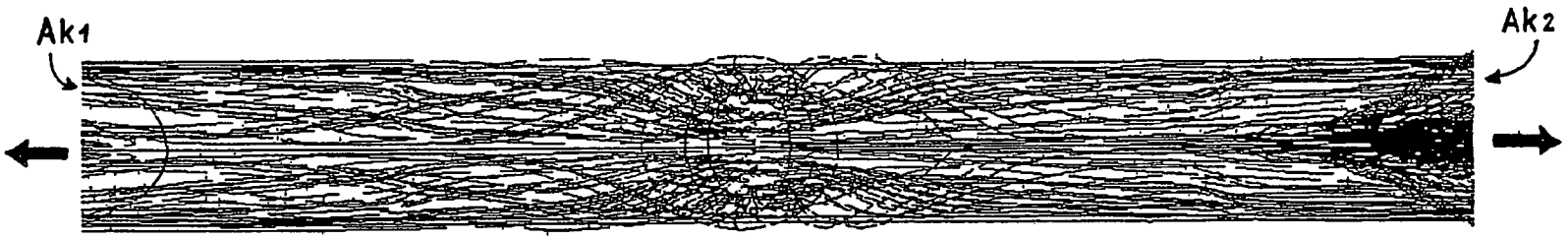
Figure 6A:
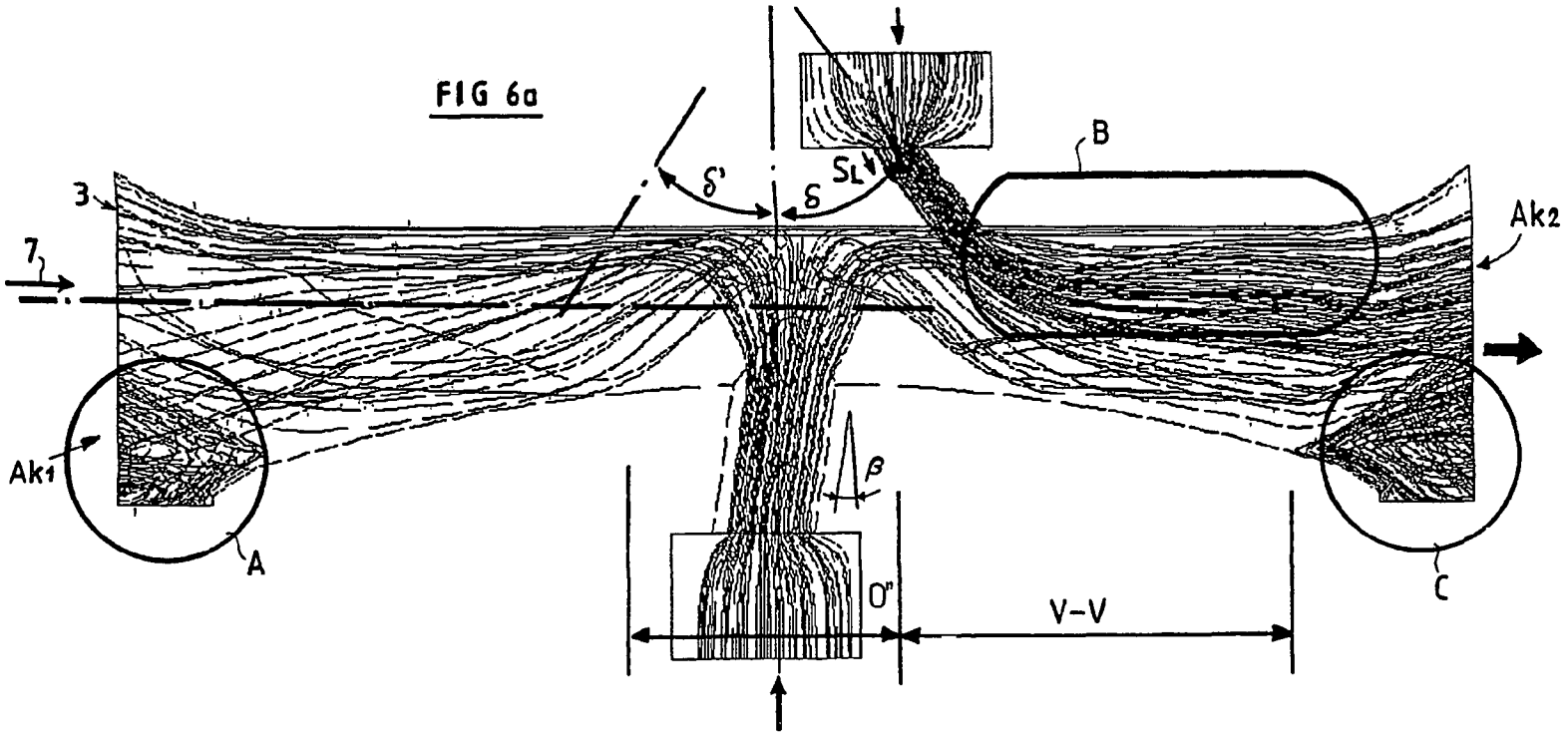
Figure 6B:
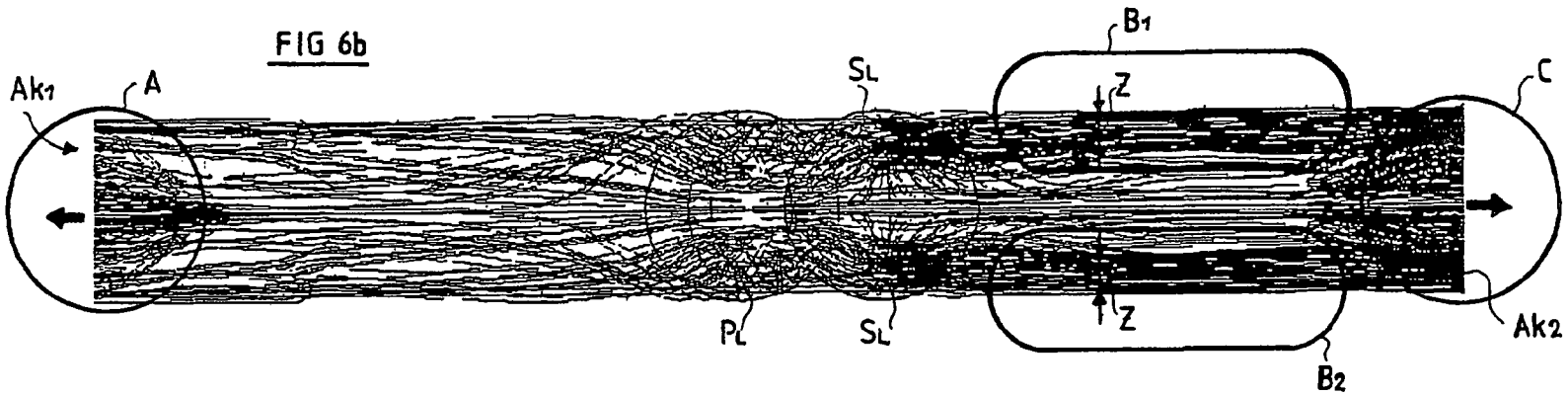
Figure 8:
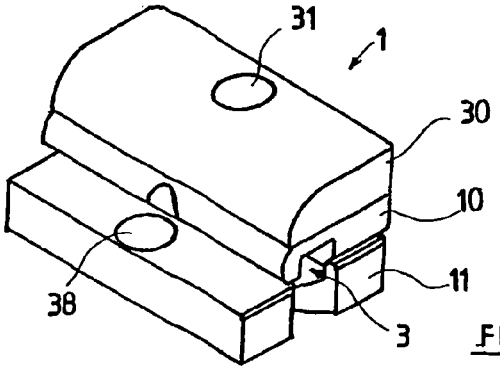
Figure 8A:
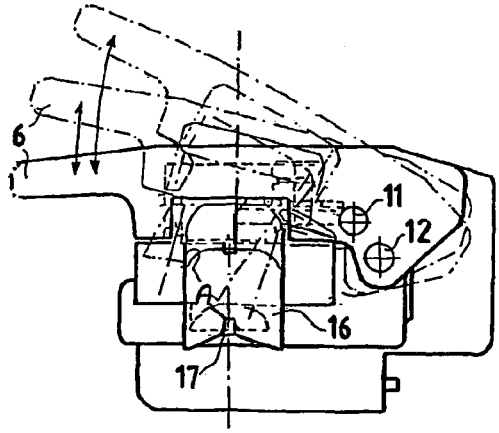
Figure 9:
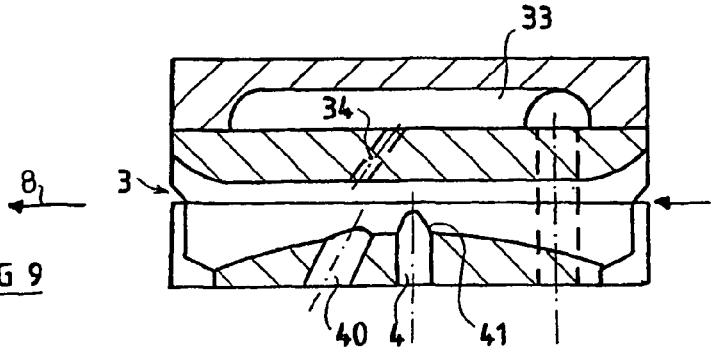
Figure 10:
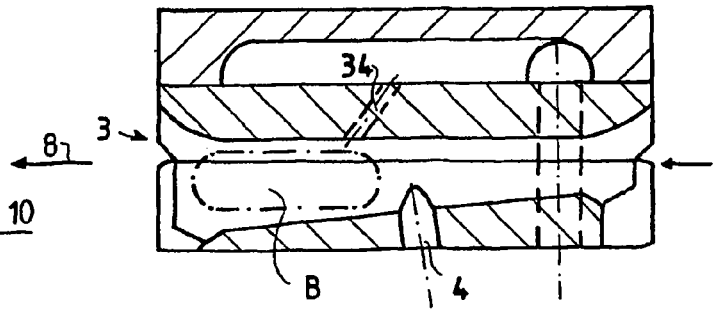
FIG. 10 shows another embodiment having a yarn channel 3 which becomes wider in the direction of conveyance. This yields a particularly preferred development of interlacing in zone B and also reduces the development of the eddy in the area of the yarn inlet.
Figure 11:
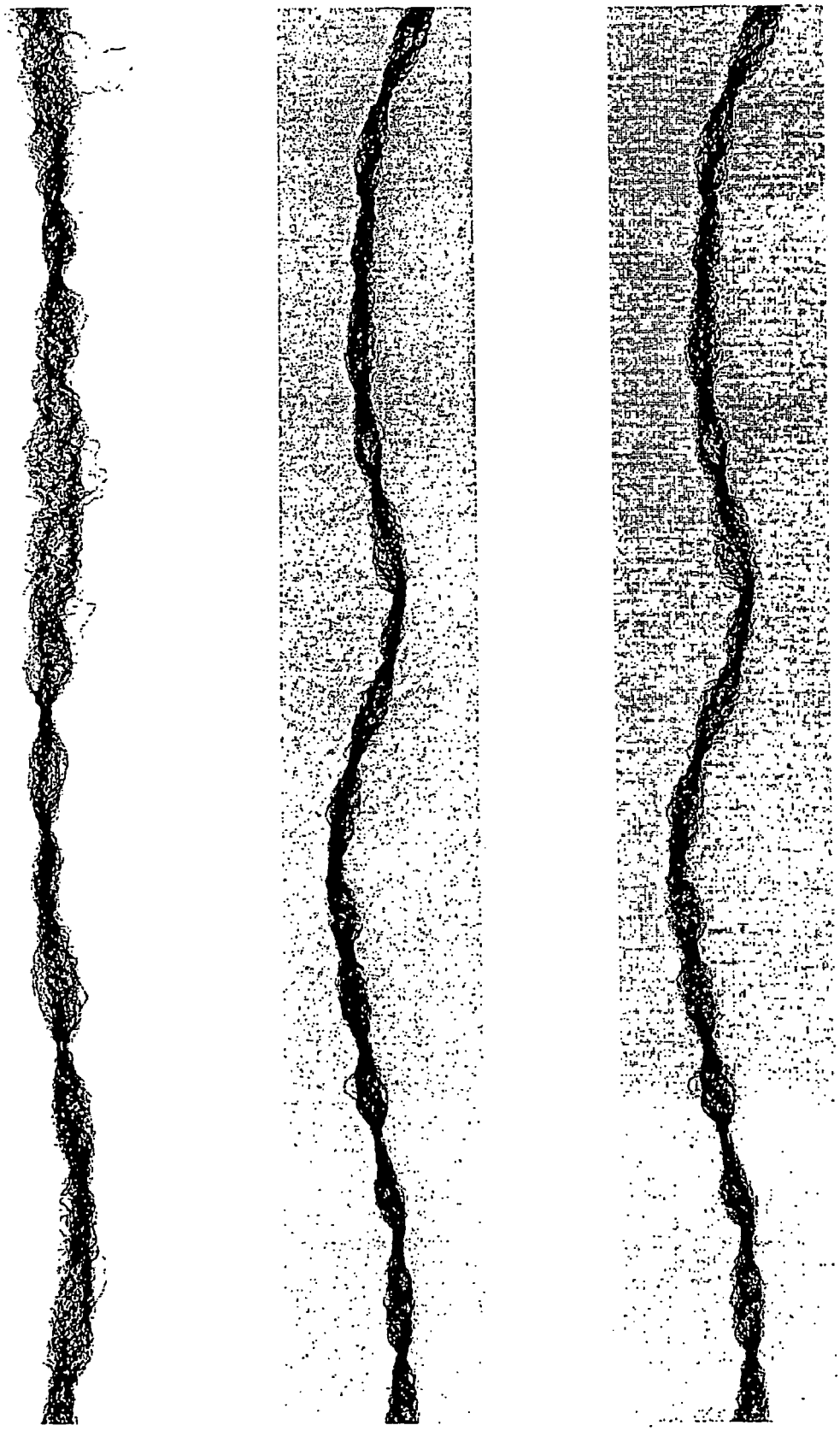
FIG. 11 shows a pattern of interlaced yarn having a nozzle according to the state of the art.
Figure 12:
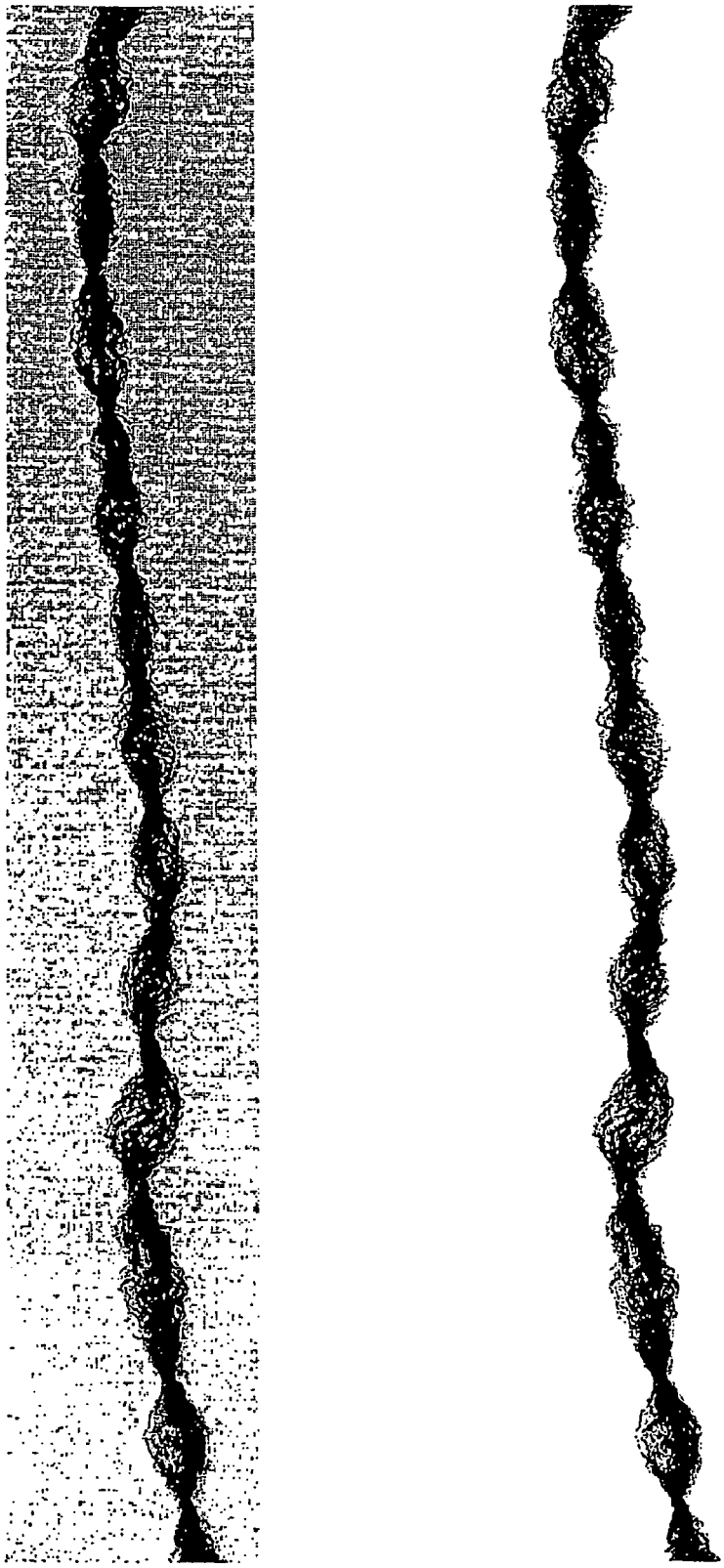

FIG. 12 shows a sample of interlaced yarn with the same starting yarn but with the novel invention. The air pressure of the feed air was 6 bar, the rate of conveyance of the yarn was 2400 m/min. The yarn titer was 2600 dtex with a filament count of 135. This is BCF tricolor yarn (polypropylene).

According to another advantageous embodiment, it is proposed that the distance A1 between the auxiliary bores and/or between the auxiliary bores and the main bore in the direction of the yarn channel shall amount to at least 1½ times the diameter D of the main bore. The transverse dimension D of the main bore is preferably oval and is smaller than the corresponding width dimension D of the yarn channel so that an edge distance of 0.1 to 0.5 mm remains between the outer edge of the main bore and the yarn channel width, with the auxiliary bore(s) being arranged in the area of the edge distance. The secondary air here acts mainly outside of the main zone of action of the primary air and is thus able to maximize the positive effects described in the introduction, namely centering and stabilizing the yarn in the yarn channel, a targeted conveyance function from yarn regardless of the interlacing function, a rotational aid for optimization of knot formation

The invention claimed is:

1. A method of producing knotted yarn from smooth and textured filament yarn in a continuous yarn channel of an interlacing nozzle, the yarn channel having an axis, the method comprising:

supplying primary air into the yarn channel through a main bore directed centrally into the yarn channel for providing interlacing flow;

supplying secondary air into the yarn channel through at least one auxiliary bore arranged at an axial distance from the main bore; and wherein the primary air is supplied into the yarn channel perpendicularly to the yarn channel axis or only with a slight angular deviation from a plane perpendicular to the yarn channel axis, in such a way that the primary air only has a slight conveyance effect or a minor effect against the conveyance; and wherein the secondary air is supplied to the yarn channel at an angle inclined with respect to a plane perpendicular to the axis of the yarn channel and in a direction different from the direction along which the primary air is supplied, for supporting the interlacing flow.

2. The method of claim 1, wherein the secondary air is supplied into the yarn channel in such a way that it has a conveying effect.

3. The method of claim 1, wherein the primary air is supplied into the yarn channel in such a way as to optimize an interlacing effect; and wherein the secondary air is supplied into the yarn channel in such a way as to optimize a conveyance effect and to aid rotation of the yarn.

4. The method of claim 1, wherein the at least one auxiliary bore includes at least two auxiliary bores symmetrically arranged at an axial distance from the main bore and having a tangential entry into the yarn channel at an angle with a deviation from a plane perpendicular to the axis of the yarn channel of between 5° and 40°, and the secondary air is supplied through the at least two auxiliary bores.

5. The method of claim 1, wherein the primary air is supplied into the yarn channel with a deviation from a plane perpendicular to the yarn channel axis of 0° to 15°.

6. The method of claim 1, wherein yarn is fed through a yarn channel having a cross section with a rounded or planar section and located on a side of the yarn channel where the main bore enters the yarn channel; and a side opposite the side of the yarn channel where the main bore enters the yarn channel has a planar or rounded baffle surface section; and the at least one auxiliary bore is arranged in the planar or rounded baffle surface section with an opening which is directed opposite to the direction of the primary air, and the secondary air is supplied through the at least one auxiliary bore.

7. The method of claim 1, wherein the secondary air is supplied into the yarn channel through the at least one auxiliary bore arranged at a distance from the main bore corresponding to about ¼ to 1⅓ opening lengths plus a knot of the yarn.

8. The method of claim 1, wherein the yarn channel has a cross section widening in both directions from the main bore towards a yarn channel inlet and a yarn channel outlet.

9. The method of claim 8, wherein the yarn channel has a side with a round cross section and the yarn channel bends as it widens.

10. A device for producing knotted yarn in a yarn channel of an interlacing nozzle, the yarn channel having an axis, the device comprising:

a main bore configured to direct primary air centrally into the yarn channel;

at least one auxiliary bore arranged at an axial distance from the main bore in a direction of yarn transport and configured to direct secondary air into the yarn channel; and wherein the main bore is arranged perpendicularly to the yarn channel or with only a slight angle deviation from a plane perpendicular to the yarn channel in such a way that it has only a minimal effect on conveyance of the yarn; and the at least one auxiliary bore is arranged at an angle inclined with respect to a plane perpendicular to the yarn channel axis and with a direction different from a direction of the main bore.

11. The device of claim 10, wherein the interlacing nozzle is a closed nozzle having a round channel cross section, and the main bore enters the yarn channel at an entry approximately at the middle of the channel and on one side of the nozzle; and the at least one auxiliary bore enters the yarn channel from a side of the nozzle opposite the entry of the main bore.

12. The device of claim 10, wherein the interlacing nozzle is designed as an open nozzle having a first half of the yarn channel formed in a carrier nozzle part and having a second half of the channel arranged in a nozzle component positioned on the carrier nozzle part; and the main bore is arranged approximately at the center of the carrier nozzle part in the direction of the yarn channel; and the at least one auxiliary bore is arranged in the nozzle component positioned on the carrier nozzle part.

13. The device of claim 10, wherein the interlacing nozzle is a clip-slide jet nozzle having an open position for threading and a closed position for normal interlacing operation, and the clip-slide jet nozzle has a stationary nozzle part and a moveable nozzle part; and the main bore is arranged approximately at the center of the yarn channel in the direction of the yarn channel and in the stationary nozzle part; and the at least one auxiliary bore is arranged in the moveable nozzle part.

14. The device of claim 10, wherein the main bore is arranged at a deviation of 0° to 10° from a plane perpendicular to the yarn axis and wherein the at least one auxiliary bore is arranged with a deviation of 10° to 45° from a plane perpendicular to the yarn axis.

15. The device of claim 10, wherein the at least one auxiliary bore has a total area of cross section corresponding to approximately ¼ to ⅓ of an area of a cross section of the main bore.

16. The device of claim 10, wherein the at least one auxiliary bore is arranged at a distance from the main bore in the direction of the yarn channel corresponding to at least 1½ times a diameter of the main bore.

17. The device of claim 10, wherein the main bore has a transverse dimension which is smaller than the corresponding transverse dimension of the yarn channel such that an edge area between an outer edge of the main bore and an outer edge of the yarn channel is formed, the edge area having a width of 0.1 mm to 0.5 mm; and wherein the at least one auxiliary bore is arranged in the edge area.

* * * * *